US011555667B2

(12) United States Patent
Sereday et al.

(10) Patent No.: US 11,555,667 B2
(45) **Date of Patent: *Jan. 17, 2023**

(54) HOLSTER SYSTEM WITH REMOVABLE SIGHT COVER

(71) Applicant: Vista Outdoor Operations LLC, Anoka, MN (US)

(72) Inventors: Daniel D. Sereday, Belgrade, MT (US); Larry A. Houck, Louisburg, KS (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/458,882

(22) Filed: Aug. 27, 2021

(65) Prior Publication Data

US 2021/0389081 A1 Dec. 16, 2021

Related U.S. Application Data

(63) Continuation of application No. 16/678,589, filed on Nov. 8, 2019, now Pat. No. 11,105,583, which is a continuation of application No. 16/037,069, filed on Jul. 17, 2018, now Pat. No. 10,473,427.

(60) Provisional application No. 62/533,281, filed on Jul. 17, 2017.

(51) Int. Cl.

| | |
|---|---|
| ***F41C 33/02*** | (2006.01) |
| ***F41G 1/16*** | (2006.01) |
| ***F41G 1/30*** | (2006.01) |
| ***F41G 1/06*** | (2006.01) |

(52) U.S. Cl.

CPC ..... *F41C 33/0254* (2013.01); *F41C 33/0209* (2013.01); *F41C 33/0263* (2013.01); *F41G 1/06* (2013.01); *F41G 1/16* (2013.01); *F41G 1/30* (2013.01)

(58) Field of Classification Search

CPC ..... F41C 33/02; F41C 33/0236; F41C 33/0254; F41C 33/0263; A45F 2200/0591

USPC ..... 224/192, 193, 198, 238, 243, 244, 911, 224/912

See application file for complete search history.

(56) References Cited

U.S. PATENT DOCUMENTS

| | | | |
|---|---|---|---|
| 5,189,555 | A | 2/1993 | Jorlov |
| 5,440,387 | A | 8/1995 | Montelin et al. |
| 5,815,936 | A | 10/1998 | Sieczka et al. |
| 5,918,784 | A | 7/1999 | Serpa |
| 6,112,962 | A | 9/2000 | Matthews |
| 6,267,279 | B1 | 7/2001 | Matthews |

(Continued)

*Primary Examiner* — Justin M Larson

(74) *Attorney, Agent, or Firm* — Reed Smith LLP; Matthew P. Frederick; Cheryl L. Gastineau

(57) ABSTRACT

A holster system for receiving and releasably retaining a handgun with or without a reflex sight mounted thereon. The holster body comprises a pair of opposing side wall portions and an upper wall portion. The holster body may define a rear accessory sight opening for receiving the handgun with the reflex sight attached thereto. The holster system may include a first rear sight cover selectively and robustly coupleable to the holster body so as to cover the rear accessory sight opening when a handgun with conventional sights extending upwardly about ⅜ of an inch or less mounted thereto is used in conjunction with the holster system. The holster system may also include a second rear sight cover selectively coupleable to the holster body so as to cover the sight opening when a handgun with a reflex sight mounted thereto is used in conjunction with the holster system.

20 Claims, 10 Drawing Sheets

(56) References Cited

U.S. PATENT DOCUMENTS

| | | | |
|---|---|---|---|
| 6,490,060 | B1 | 12/2002 | Tai et al. |
| 6,547,111 | B2 | 4/2003 | French |
| 6,641,009 | B2 | 11/2003 | French et al. |
| 7,434,712 | B2 | 10/2008 | Cook et al. |
| 7,461,765 | B2 | 12/2008 | French et al. |
| 7,556,181 | B2 | 7/2009 | Spielberger |
| 7,694,860 | B2 | 4/2010 | Clifton, Jr. |
| 7,735,255 | B1 | 6/2010 | Kincaid |
| 7,841,497 | B1 | 11/2010 | Gregory et al. |
| 7,937,880 | B1 | 5/2011 | Fidlow |
| 7,954,971 | B1 | 6/2011 | Kincaid et al. |
| 8,132,355 | B1 | 3/2012 | Kincaid et al. |
| 8,177,108 | B1 | 5/2012 | Kincaid et al. |
| 8,235,263 | B1 | 8/2012 | Yeates et al. |
| 8,474,670 | B1 | 7/2013 | Gregory et al. |
| 8,517,235 | B1 | 8/2013 | Kincaid et al. |
| 8,631,981 | B2 | 1/2014 | Zusman |
| 8,684,242 | B2 | 4/2014 | Pomeroy |
| 8,690,032 | B2 | 4/2014 | Baumann et al. |
| 8,720,755 | B2 | 5/2014 | Gregory et al. |
| 8,870,042 | B2 | 10/2014 | Clifton |
| 8,985,412 | B2 | 3/2015 | Rorick et al. |
| 9,022,262 | B2 | 5/2015 | Pellegrini |
| 9,057,579 | B2 | 6/2015 | Rorick et al. |
| 9,057,580 | B2 | 6/2015 | Rorick et al. |
| 9,134,093 | B2 | 9/2015 | Yeates |
| 9,175,925 | B2 | 11/2015 | Pellegrini |
| 9,383,165 | B2 | 7/2016 | Gregory |
| 9,423,212 | B2 | 8/2016 | Campean |
| 9,541,348 | B2 | 1/2017 | Rogers |
| 9,759,515 | B2 | 9/2017 | Yeates |
| 9,777,986 | B1 | 10/2017 | Lance et al. |
| 9,958,234 | B2 | 5/2018 | Campean |
| 10,330,435 | B2 | 6/2019 | McKendrick |
| 10,458,748 | B2 | 10/2019 | Yeates |
| 10,473,427 | B1 | 11/2019 | Sereday et al. |
| 10,619,974 | B2 | 4/2020 | Smith et al. |
| 2005/0035163 | A1 | 2/2005 | French |
| 2005/0206521 | A1 | 9/2005 | Shults |
| 2010/0083554 | A1 | 4/2010 | Elpedes et al. |
| 2011/0101063 | A1 | 5/2011 | Zusman |
| 2013/0181020 | A1 | 7/2013 | Rogers |
| 2014/0042196 | A1 | 2/2014 | Pellegrini |
| 2014/0048572 | A1 | 2/2014 | Yeates |
| 2014/0048573 | A1 | 2/2014 | Pellegrini |
| 2014/0061262 | A1 | 3/2014 | Pomeroy |
| 2018/0023921 | A1 | 1/2018 | Chavez |
| 2020/0292272 | A1 | 9/2020 | Treto et al. |

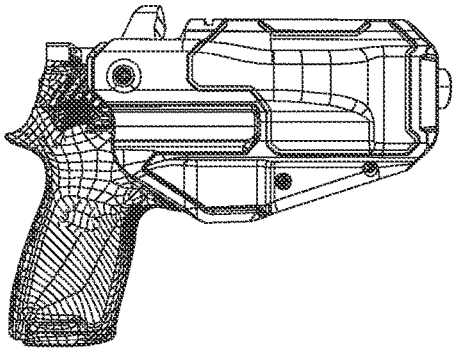
FIG. 2B
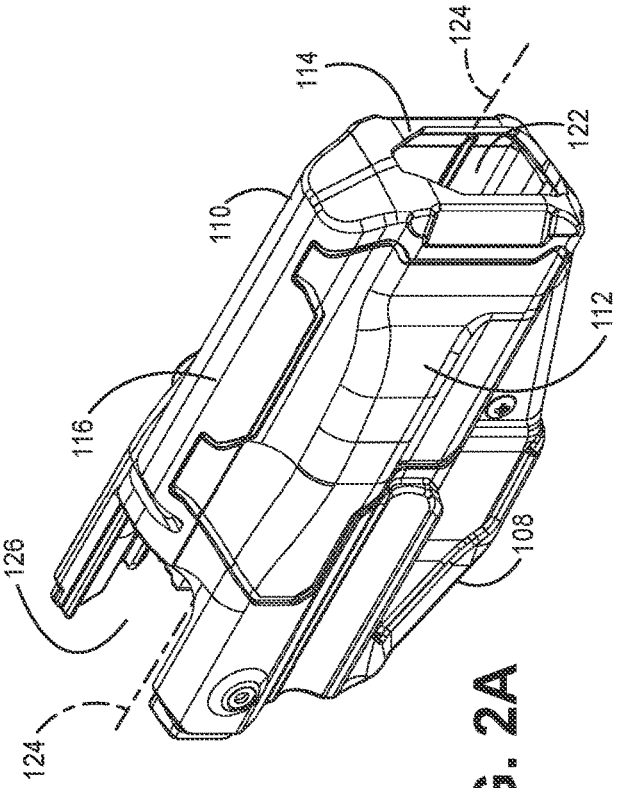
FIG. 2A
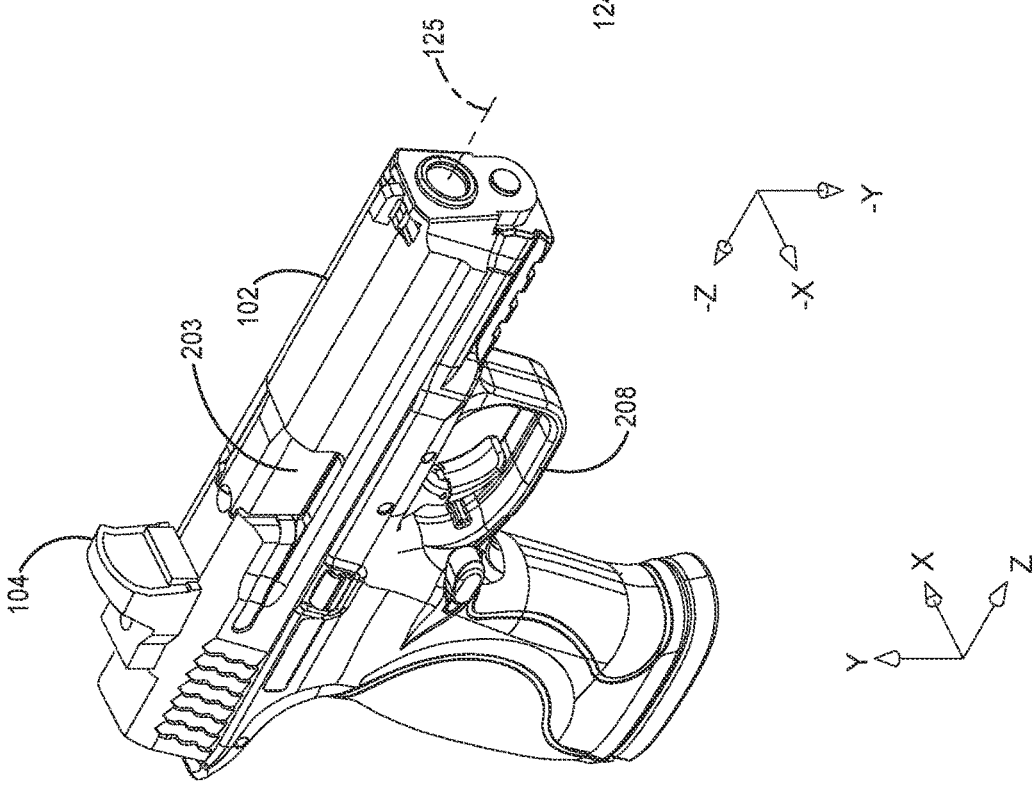

HOLSTER SYSTEM WITH REMOVABLE SIGHT COVER

CROSS-REFERENCE TO RELATED APPLICATIONS

This application is a continuation of U.S. application Ser. No. 16/678,589, filed Nov. 8, 2019, which is a continuation of U.S. application Ser. No. 16/037,069, filed Jul. 17, 2018, which claims the benefit of U.S. Provisional Patent Application No. 62/533,281, filed Jul. 17, 2017, the disclosures of which are hereby incorporated by reference herein in their entirety.

BACKGROUND OF THE DISCLOSURE

Handguns that are carried by police and military are carried in holsters that are externally worn and that have varying degrees of security levels depending primarily upon on the intended context of use. Such holsters are formed of rigid polymers and cover most of the handgun frame, most or all of the slide portion, and usually all of the trigger guard of the handgun while leaving the hand grip exposed for grasping. The majority of such holsters for the police and military are worn adjacent to the left or right hip depending on whether the user is left or right handed and are worn with the handgun pointing downward when the user is standing. Such holsters have a polymer wall portions including a proximal wall portion adjacent to the user, a distal wall portion opposite from the proximal wall portion. The holsters typically have at least one finger operated release mechanism, operated by the thumb or fore finger, that releases a movable stop member that releasably engages either the ejection proximal or trigger guard of the handgun.

Conventional handguns have a sight with a post as a forward sight and a sight with a rear open sight with a V or U shaped notch to which the post is aligned for aiming. Such sights extend upward nominally from a handgun slide, typically one fourth or three eighths of an inch. Semi-automatic handguns generally always come with such sights attached. These sights are often called "iron sights" although they are usually not made of iron. Conventional holsters are designed to accommodate such conventional iron sights.

Weapon-mounted handgun accessories have become an important tool for military, police, and civilian firearm users. A number of weapon-mounted firearm accessories can be used to facilitate aiming the weapon. Examples of popular firearm accessories include targeting devices, such as laser sighting devices, and target illuminators, such as flashlights.

One type of sighting device that has seen increasing popularity in recent years is the type of the sighting device general referred to in the art as a reflector sight, a reflex sight, and/or a red dot sight. This type of gunsight is an optical device that allows the user to look through a partially reflecting glass element and see an illuminated projection of an aiming point or reticle superimposed on the field of view. More recently, these sighting devices have been designed for mounting on the top of handguns, for example, on the slide.

Holsters have traditionally been designed with form factors quite close to the specific handgun and with the main holster enclosure formed of a single molded part. This contributes to the robustness and integrity of the holster when needed for holding and securely retaining the handgun in demanding situations. In that holsters are injection molded, it may be required to have a separate mold for a holster design for each different handgun. Also, holster designs for a left handed person will need to be modified for a right handed person, again requiring a new mold. To the extent an accessory is to be mounted on the handgun, a new holster design and correspondingly a new mold is typically needed to accommodate the accessory. Molds for injection molding are expensive. In that such handgun mounted accessories may not be permanent fixtures on a user's handgun, the user may then requires two holsters if they plan on carrying their handgun with and without the accessory.

Any improvement for reducing manufacturing costs, reducing the number of holsters needed by handgun users, without reducing the integrity and robustness of the holster, and thereby reducing the ultimate cost to the user, would be welcomed.

SUMMARY

A holster system for receiving and releasably retaining a handgun with or without a reflex sight mounted thereto is disclosed. The holster of the holster system comprises a holster body comprising a proximal side wall portion disposed opposite a distal side wall portion and an upper wall portion extending between the upper ends of the side wall portions. The holster may also include a capture and release mechanism for retention of the handgun in the holster. The capture and release mechanism may include a finger actuated handle or button for releasing the handgun from the holster. The wall portions of the holster body define a pocket or cavity with an open rearward end and having cavity having a handgun receiving and withdrawal axis. The holster body defining a rear accessory sight opening for receiving the handgun with the reflex sight attached thereto. The rear accessory sight opening may be positioned, for example, at a rearward end of the upper wall portion and positioned intermediate the distal side wall portion and the proximal side wall portion. The holster system having a first rear sight cover selectively and robustly coupleable to the holster body so as to cover the rear accessory sight opening, for example, when a handgun with iron sights mounted thereto is used in conjunction with the holster system. The holster system may also include a second rear sight cover selectively coupleable to the holster body so as to cover the rear sight opening, for example, when a handgun with a reflex sight mounted thereto is used in conjunction with the holster system. In some embodiments, the second rear sight cover has a hump portion. The hump portion of the second rear sight cover may define a rear sight pocket dimensioned and configured to receive the reflex sight mounted to the handgun.

The first rear sight cover may comprise a latch member. In some example embodiments, the latch member of the first rear sight cover comprising a resilient cantilever portion with a protrusion portion at an end of the cantilever portion. The protrusion portion may have a ramped surface as shown in the figures. The second rear sight cover may comprise a similar latch member with a resilient cantilever portion with a ramped protrusion portion. In some embodiments, the upper wall portion of the holster body defines an aperture positioned and dimensioned to cooperate with both the protrusion portion of the first rear sight cover and the protrusion portion of the second rear sight cover. In some example embodiments, the protrusion portion of each latch member is received in the aperture when the cover is selectively coupled to the holster body. During coupling of a cover to the holster body, the ramped surface engages may engage a complementary surface of the upper wall portion of the holster body as the distal tab and the proximal tab of the cover travel forward along the distal groove and the proximal groove, respectively. The ramped surface may be adapted and dimensioned so that deflection of the resilient cantilever portion of the latch member occurs as the ramped surface slides along the complementary surface of the upper wall portion of the holster body as the distal tab and the proximal tab travel forward along the distal groove and the proximal groove, respectively. Bending stresses in the resilient cantilever portion may be released, at least in part, when the protrusion portion is received in the aperture defined by the upper wall portion of the holster body.

A feature and benefit of embodiments is a holster system including a plurality of covers that can be quickly attached to a holster and detached from the holster. The covers may be attached to the holster to convert the holster from a first of operation to a second mode of operation. The covers may be detached from the holster to leave an open slot in the holster body that receives a handgun accessory such as a reflex sight. The system may include a cover that is dimensioned and configured to that receive a handgun accessory such as a reflex sight. The cover may be detachably attached to the holster body.

A feature and benefit of embodiments is a holster system including one or more rear sight covers that can be quickly removed and/or replaced on a holster and that when attached are secure on the holster body.

A feature and benefit of embodiments is a holster system including one or more sight covers secured to a holster without the use of threaded fasteners such as screws. In these embodiments, the possibility that threaded fasteners will come loose is eliminated. The possibility that the threads of a fastener will become stripped is also eliminated in these embodiments.

A feature and benefit of embodiments is a holster system including one or more rear sight covers secured to a holster without the use of external fasteners of any kind. In these embodiments, the possibility that small fastener components will be lost or misplaced is eliminated.

A feature and benefit of embodiments is a holster system including one or more sight covers secured to a holster in way that allows the position of the covers to be selectively attached and detached without the use of any tools. This feature and benefit allows a user to configure the holster system to a while away from home and office.

A feature and advantage is that the holsters and sight covers herein may be injection molded and the connections and interfaces are unitary and integral with the injection molded holster body and sight covers.

The above summary is not intended to describe each illustrated embodiment or every implementation of the present disclosure.

DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 2A is a perspective view showing a handgun, an optical sighting device mounted on the handgun, and a holster system accommodating the optical sighting device in accordance with the detailed description.

FIG. 2B is a side elevation view of the holster of FIG. 2A with the handgun holstered.

Figures 1A, 1B:
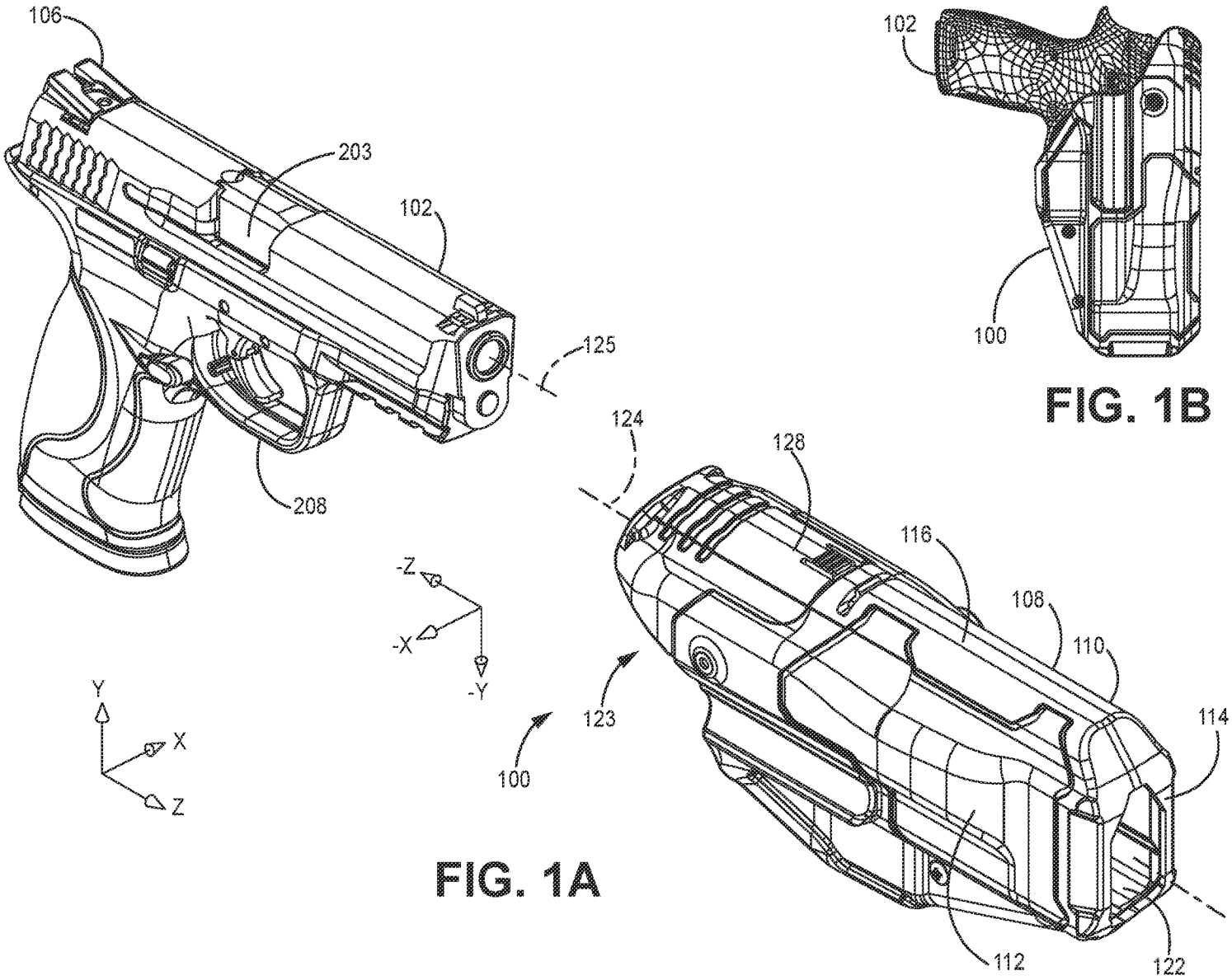
FIG. 1A is a perspective view showing a handgun with iron sights and a holster system in accordance with the detailed description.
FIG. 1B is a side elevation view of the holster of FIG. 1A with the handgun holstered.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 1A-3, a holster system 100 for receiving and releasably retaining a handgun 102 with or without a reflex sight 104 mounted thereto is disclosed. The holster 108 of the holster system 100 may comprise a holster body 110 comprising a distal side wall portion 112 disposed opposite a proximal side wall portion 114 and an upper wall portion 116 extending between the upper ends of the side wall portions. The wall portions of the holster body 110 may define a cavity 122 with an open rearward end 123. The cavity 122 having a handgun receiving and withdrawal axis 124 that is generally parallel to the handgun barrel axis 125. The holster body 110 defines a rear accessory sight opening 126 for receiving the handgun 102 with the reflex sight 104 attached thereto. With reference to the figures, the sight opening 126 may be positioned at a rearward end of the upper wall portion 116 and positioned intermediate the distal side wall portion 112 and the proximal side wall portion 114. The holster system 100 may include a first rear sight cover 128 selectively coupleable to the holster body 110 so as to cover the rear accessory sight opening 126, for example, when a handgun 102 with iron sights 106 mounted thereto is used in conjunction with the holster system 100. The holster system 100 may also include a second rear sight cover 130 selectively coupleable to the holster body 110 so as to cover the rear accessory sight opening 126, for example, when a handgun 102 with a reflex sight 104 mounted thereto is used in conjunction with the holster system 100. The rear accessory sight cover may have 130 has a hump portion 132 defining an accessory sight pocket 134 dimensioned and configured to receive the reflex sight 104 mounted to the handgun 102.

Referring to FIGS. 1A-2B, in one holster system, a single cover is utilized for a handgun with a traditional sight, the single cover covering the iron sights of the handgun. When a upwardly projecting sight the extends higher than the conventional rear iron sights is mounted on the handgun, that sight then will precludes holstering of the handgun due to interference of the sight with the holster, the single cover may be removed allowing the handgun with the upwardly protruding sight to be holstered as shown in FIG. 2B.

Referring to FIGS. 4-7, an interface features of the covers and holster body are illustrated. In one or more embodiments, the first rear sight cover 128 and second rear sight cover 130 each comprise a pair of side walls 131 including a distal cover wall 136 disposed opposite a proximal cover wall 138; an upper cover wall 140 extending between upper ends of the side walls. The second rear sight cover 130 may include a pair or tabs 141 or rails including a distal tab 142 projecting from a distal facing outer surface 144 of the distal cover wall 136 and an opposite proximal tab 152 projecting from a proximal outer surface 154. The holster body 110 may include a distal lip 146 and a distal rib 148 projecting inwardly defining a distal groove 150, and proximal lip 158 and proximal rib defining a proximal groove 155. The grooves defining a slot 155 adapted to slidingly receive the covers by way of the rails or tabs 141 of the first rear sight cover 128 or the second rear sight cover 130 when one of the covers is selectively coupled to the holster body 110. As shown in the figures, the tabs, grooves, and slot extend axially and may be parallel to the insertion and withdrawal axis 124.

The first and second rear sight covers 128, 130 may comprise a latch member 160. In some example embodiments, the latch member 160 of the sight covers 128, 130 comprising a resilient cantilever portion 162 supporting a protrusion portion 164. The protrusion portion 164 may have a ramped surface 166 as shown in the figures.

The upper wall portion 116 of the holster body 110 defines an aperture 168 positioned and dimensioned to cooperate with both the protrusion portion 164 of the first or second rear sight covers 128, 130. In some example embodiments, the protrusion portion 164 of each latch member 160 is received in the aperture 168 when the cover is selectively coupled to the holster body 110. During coupling of a cover to the holster body 110, the ramped surface 166 engages a complementary surface 170 of the upper wall portion 116 of the holster body 110 as the distal tab 142 and the proximal tab 152 of the sight cover travel forward along the distal groove 150 and the proximal groove 172, respectively. The ramped surface 166 may be adapted and dimensioned so that deflection of the resilient cantilever portion 162 of the latch member 160 occurs as the ramped surface 166 slides along the complementary surface 170 of the upper wall portion 116 of the holster body 110 as the distal tab 142 and the proximal tab 152 travel forward along the distal groove 150 and the proximal groove 172, respectively. Bending stresses in the resilient cantilever portion 162 may be released, at least in part, when the protrusion portion 164 is received in the aperture 168 defined by the upper wall portion 116 of the holster body 110 in a snap fit thus providing a snap-on connection 169.

Thus the covers and holster body have cooperating features for alignment and sliding engagement, the tabs and grooves, and cooperating locking features, the latch member and aperture. In embodiments the positioning of these cooperating features could be reversed, that is a pair of rails or tabs on the covers and the grooves on the holster body, the grooves defining a slot sized for receiving the rails defining a cooperating rails and slot connection 165. Of course, other cooperating features could be utilized as well other than the specific structure described herein.

FIGS. 4-8, 10 and 11 also illustrate overlapping edge portions 173, 174 on the covers 128, 130 and holster body 110 that provide further integrity to the connection between the sight covers and the holster body. The overlapping edge portions are extensions of the walls of the respective holster body and sight covers. The holster body overlapping edge portions 174 being captured within the overlapping edge portions 173 of the sight covers thus providing overlapping wall portions. Additionally the overlapping edge portions of the covers abut up against stop surfaces 175 on the holster body and the overlapping edge portion 173 of the sight covers abut against stop surfaces 176 on the holster body.

Figure 11:
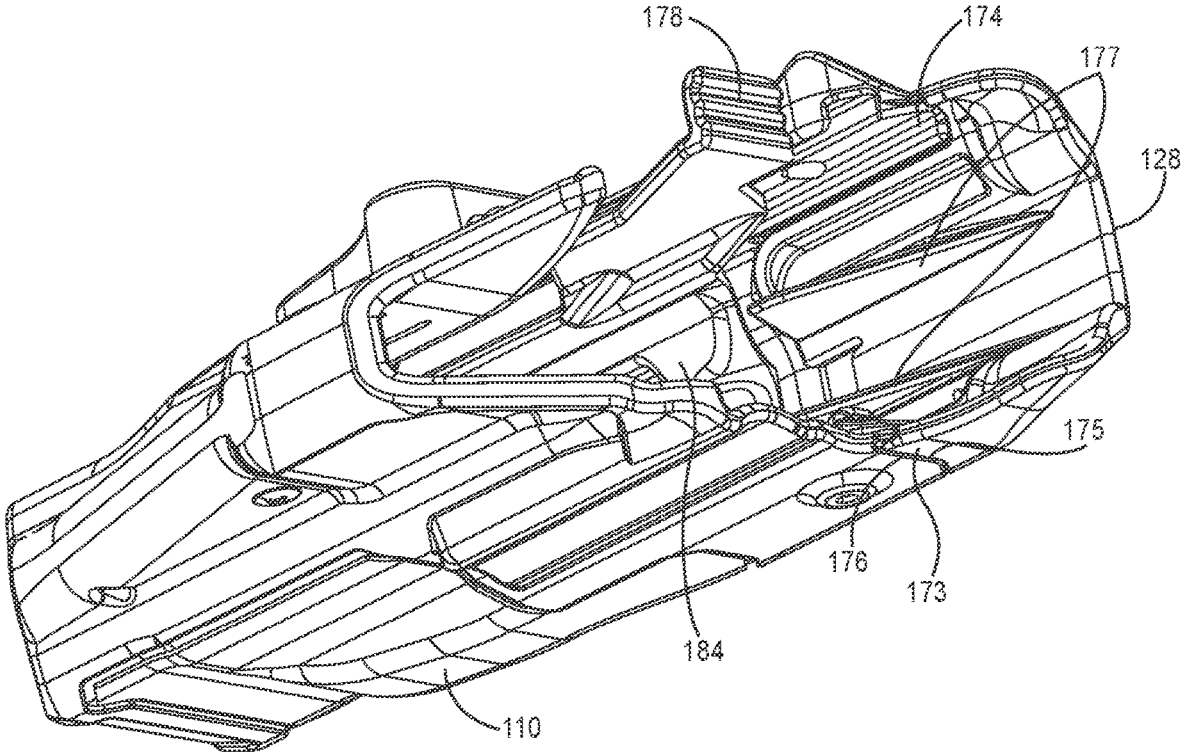
FIG. 11 is a perspective view showing a holster and a cover in accordance with the detailed description.

FIG. 11 also shows triangular gussets 177 that facilitate guiding the handgun into the holster and rigidify the sight cover.

The overlapping edge portions extend laterally outward and downwardly on the holster body and covers with a curved portion providing essentially a 90° turn of the edge portions. This arrangement adds further robustness to the assembled holster body 110 and sight covers.

Figure 7:
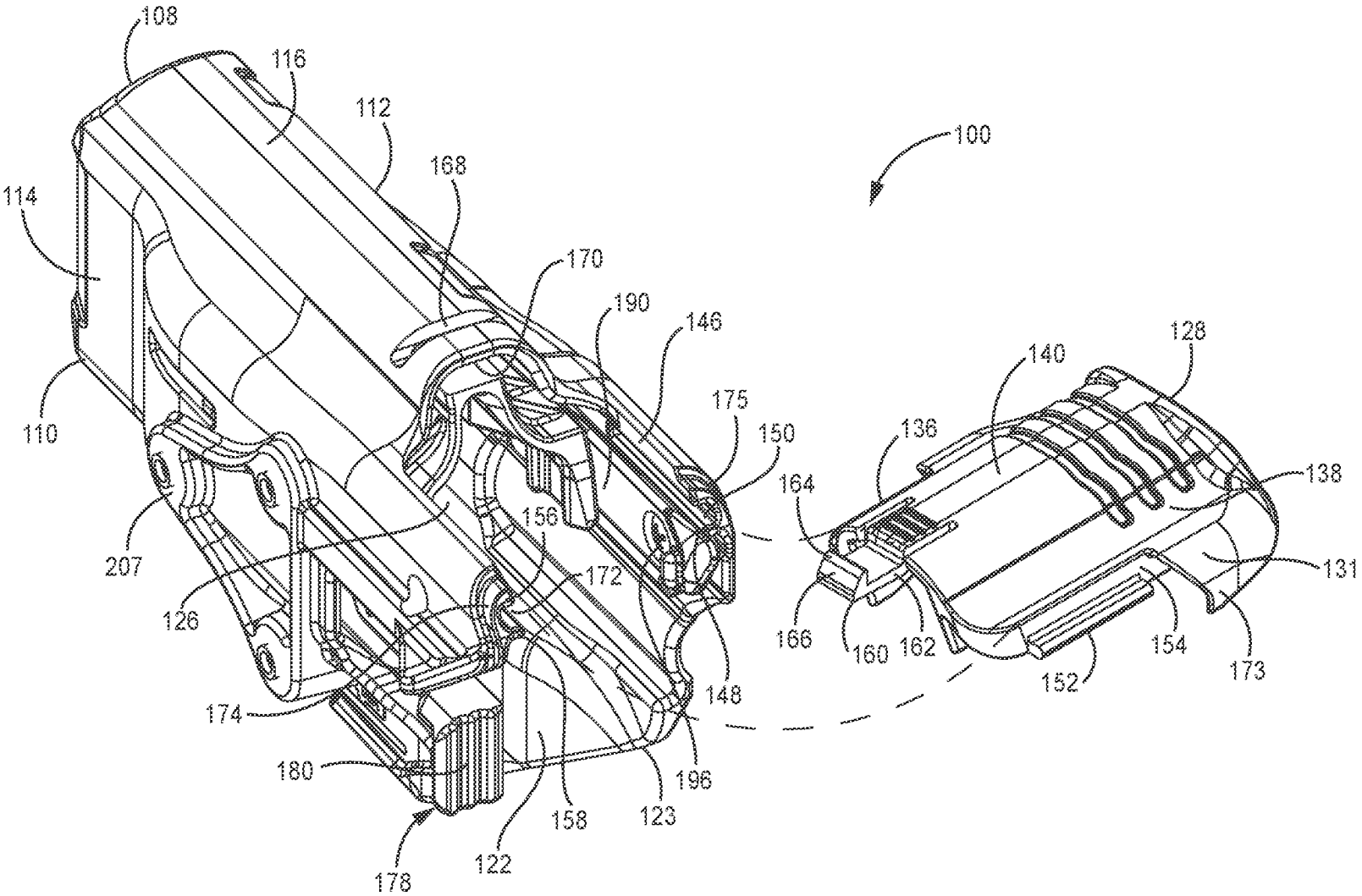
FIG. 7 is a partially exploded perspective view showing a holster and a cover in accordance with the detailed description.
Figure 8:
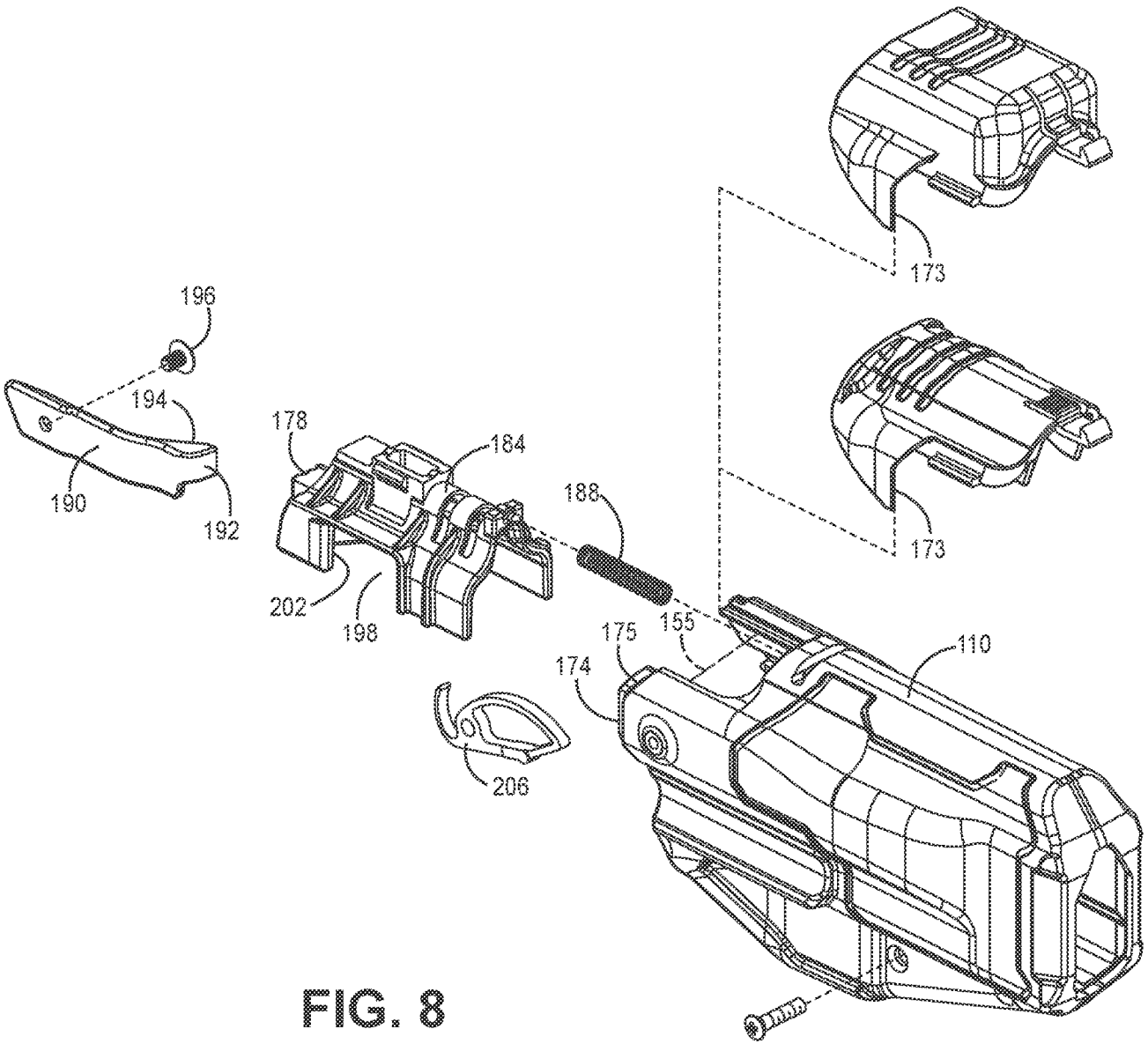
FIG. 8 is an exploded view of the holster system showing the alternate covers and the capture and release mechanism.
Figure 10:
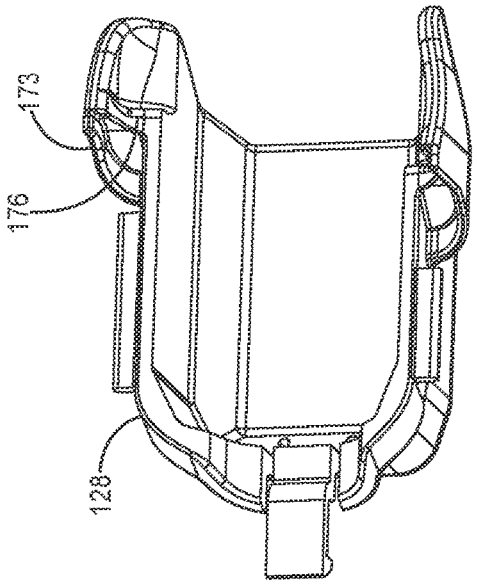
FIG. 10 is a view of the underside of a sight cover.
Figure 9:
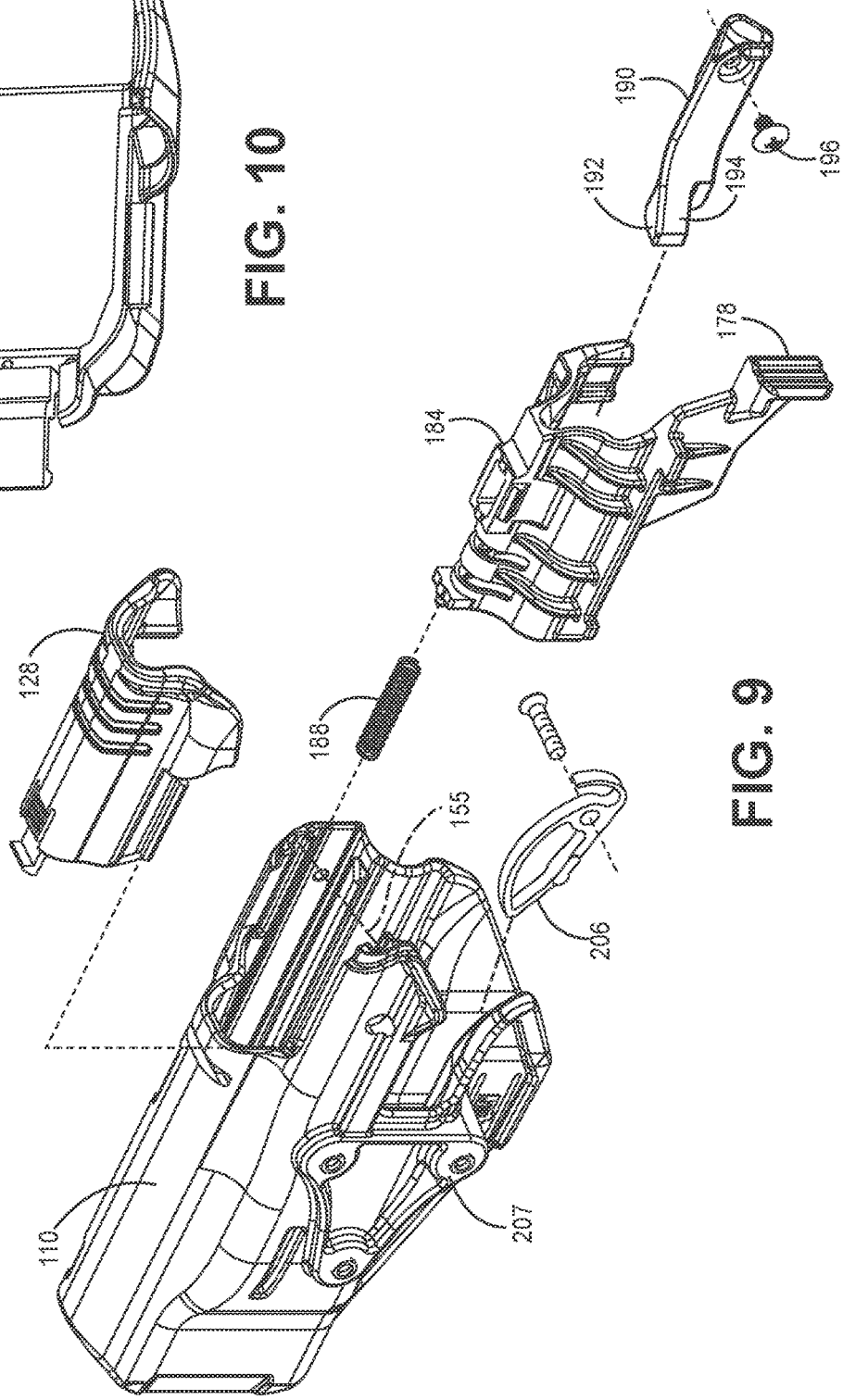
FIG. 9 is an exploded view of the holster system from the opposite view of FIG. 8.

FIGS. 4-9 also illustrate a suitable a capture and release mechanism 178 for retention of the handgun 102 in the holster. As shown in the figures, the capture and release mechanism 178 may include a finger actuated handle or button 180 for releasing the handgun 102 from the holster 108. An exploded view of the holster system with the capture and release mechanism 178 is shown in FIG. 8. A sleeve 184, integral with the button 180, is slidingly engaged in the top of the holster body and is biased rearwardly by a captured spring 188. A cantilevered ejection port catch lever 190 has an ejection port stop portion 192 and a cam surface 194. The catch lever attaches to the inside surface of the holster body such as by a screw 196 such that the ejection port stop portion 192 and cam surface 194 are positioned in the window 198 of the sleeve 184. Whereby when the pushbutton 178 is depressed forwardly the sleeve 184 slides forwardly in the holster body 110 a cam engagement surface 202 of the sleeve deflects the ejection port stop portion from a blocking position where the ejection port blocking portion is position in the ejection port 203 of the handgun (see FIGS. 1A, 2A, and 3) to a non-blocking positon. When the holster does not have a handgun therein, insertion of the handgun can also cause deflection of the ejection port stop portion 192 to a non-blocking position by engagement of the cam surface with the handgun.

Figure 5:
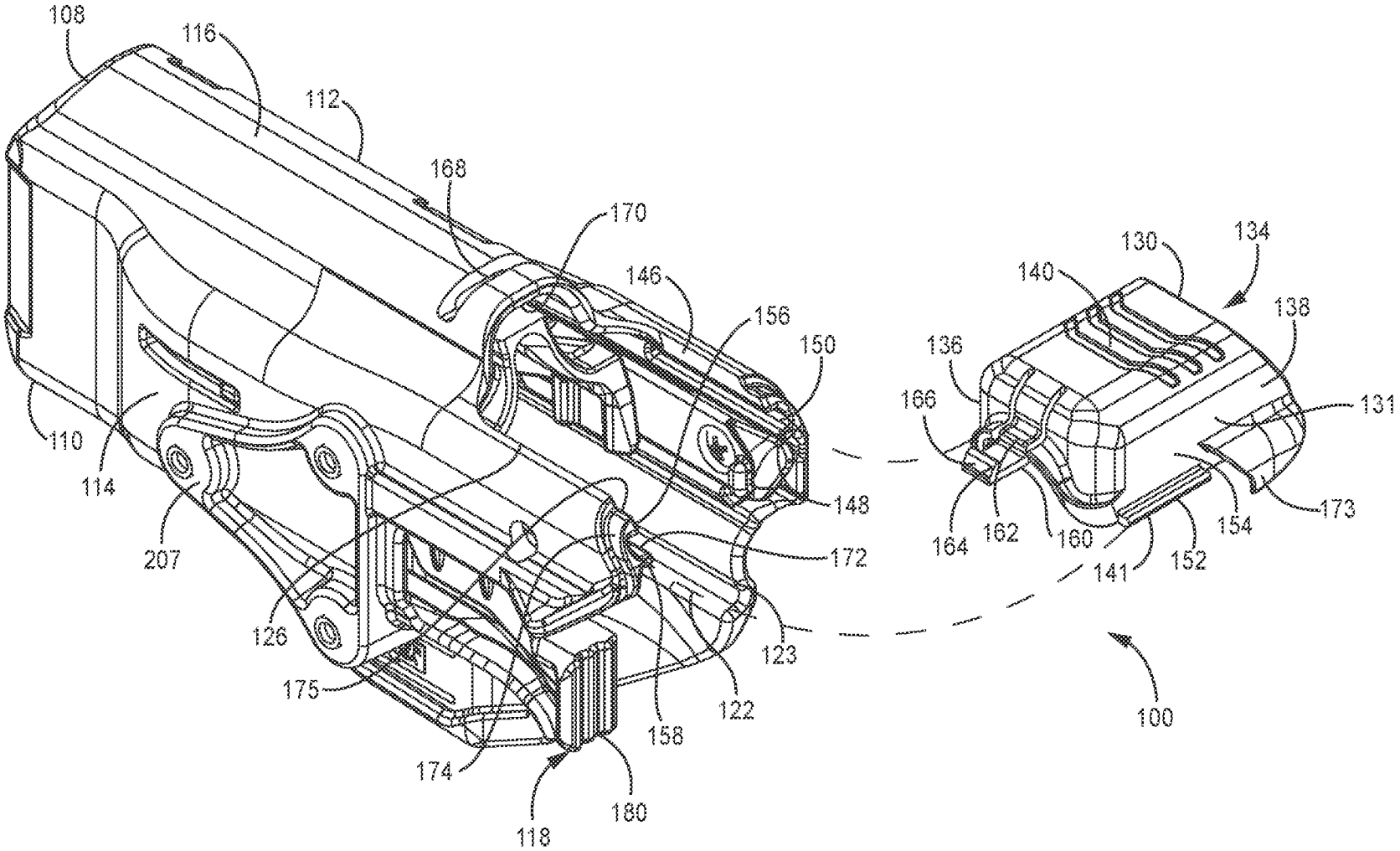
FIG. 5 is a partially exploded perspective view showing a holster and a cover in accordance with the detailed description.
Figure 6:
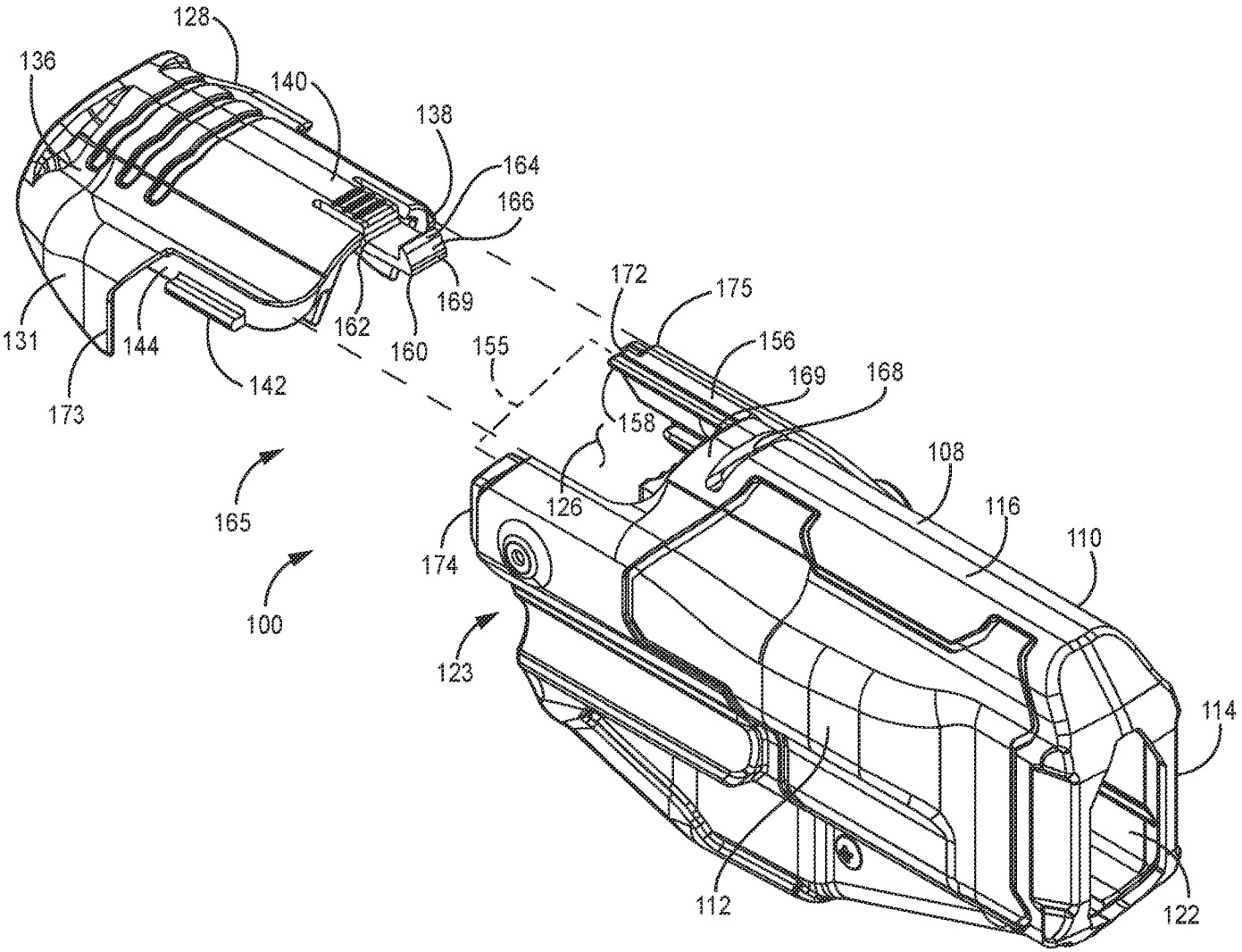
FIG. 6 is a partially exploded perspective view showing a holster and a cover in accordance with the detailed description.

FIGS. 5 and 7 also illustrate a conventional interface 207 for attaching the holster to a belt plate or other system for allowing the holster to be worn by the user.

FIG. 8 also discloses a tensioning member 206 that is positioned at the bottom of the holster body in the cavity and engages the trigger guard 208 of the handgun.

The capture and release mechanism 178 may comprise various other mechanisms without deviating from the spirit and scope of the detailed description. Mechanisms and other components that may be suitable in some applications of the inventions herein are disclosed in the following United States patents, all of which are hereby incorporated by reference herein for all purposes: U.S. Pat. Nos. 5,918,784, 6,112,962, 6,267,279, 6,547,111, 6,641,009, 7,937,880, 7,434,712, 7,461,765, 7,556,181, 7,694,860, 7,841,497, 7,954,971, 8,132,355, 8,177,108, 8,235,263, 8,474,670, 8,517,235, 8,690,032, 8,720,755, 8,985,412, 9,057,579, 9,057,580, 9,134,093, 9,759,515, and 9,779,86.

Figure 3:
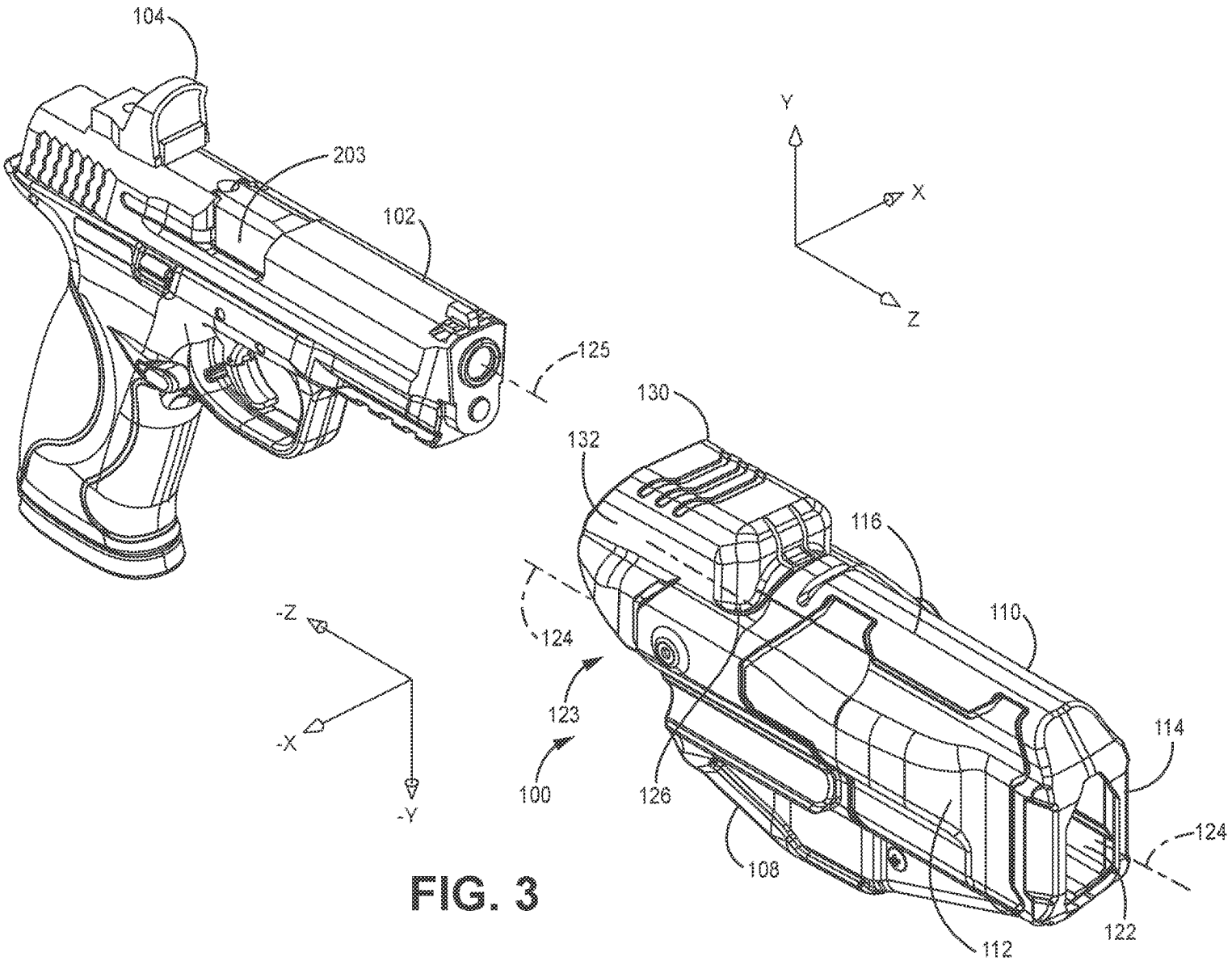
FIG. 3 is a perspective view showing a handgun, an optical sighting device mounted on the handgun, and a holster system in accordance with the detailed description.
Figure 4:
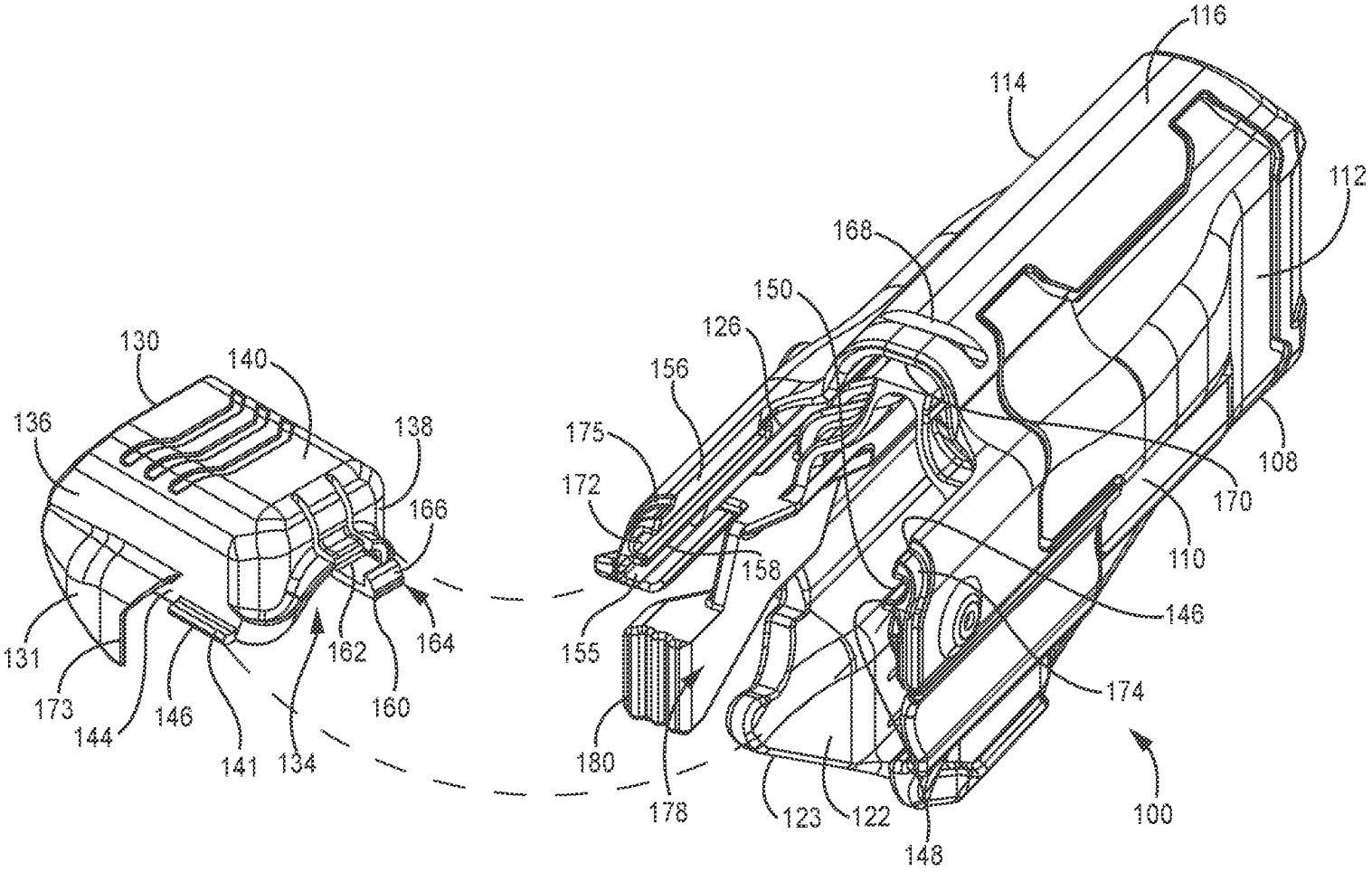
FIG. 4 is a partially exploded perspective view showing a holster and a cover in accordance with the detailed description.

Referring to FIGS. 1 through 3, a forward direction Z and a rearward direction−Z are illustrated using arrows labeled "Z" and "−Z," respectively. A proximal direction X, toward the user, and a distal direction−X, away from the user, are illustrated using arrows labeled "X" and "−X," respectively for a right handed user that mounts the holster on his right side. For left handed use the X and −X would be reversed. An upward direction Y and a downward direction−Y are illustrated using arrows labeled "Y" and "−Y," respectively. The directions illustrated using these arrows may be conceptualized, by way of example and not limitation, from the point of view of a user holding a handgun in a normal firing position and viewing the gunsights of the handgun. The directions illustrated using these arrows may be applied to the apparatus shown and discussed throughout this application. The proximal direction may also be referred to as the portward direction. In one or more embodiments, the upward direction is generally opposite the downward direction. In one or more embodiments, the upward direction and the downward direction are both generally orthogonal to the ZX plane defined by the forward direction and the distal direction. In one or more embodiments, the forward direction is generally opposite the rearward direction. In one or more embodiments, the forward direction and the rearward direction are both generally orthogonal to the XY plane defined by the upward direction and the distal direction. In one or more embodiments, the distal direction is generally opposite the proximal direction. In one or more embodiments, the distal direction and the proximal direction are both generally orthogonal to the ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "proximally" and "distally," should not be interpreted to limit the scope of the invention recited in the attached claims.

Reflex sighting devices work on the optical principle that anything at the focus of a lens or curved mirror (such as an illuminated aiming point) will look like it is sitting in front of the viewer at infinity. The invention herein is also applicable for other sighting devices that mount onto a handgun, that project upwardly, and that would otherwise prevent holstering of the handgun in a holster with a holster body sized for the handgun without such a sighting device mounted thereon. Holster systems herein could also include holsters design for revolvers that do not have the ejection port. In such holsters the capture and release mechanisms can attach to other parts of the holster. A reflex type sight is illustrated in U.S. Pat. Pub. 2018/0023921, said patent publication is incorporated by reference. Other such sights are disclosed in U.S. Pat. Nos. 9,958,234, 9,423,212, 6,490,060, 5,815,936, 5,440,387, and 5,189,555. Said patents are incorporated herein by reference.

The patents and other references mentioned above in all sections of this application are herein incorporated by reference in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A holster system for receiving and releasably retaining a handgun with iron sights and with or without a reflex sight mounted thereto, the holster system comprising:

a holster body comprising a distal side wall portion disposed opposite a proximal side wall portion and an upper wall portion extending between the upper ends of the side wall portions;

the wall portions of the holster body defining a cavity with an open rearward end, the cavity having a handgun receiving and withdrawal axis;

the holster body defining a rear accessory sight opening for receiving the reflex sight when the handgun is at least partially received in the cavity and the reflex sight attached thereto, the rear accessory sight opening positioned at a rearward end of the upper wall portion and positioned intermediate the distal side wall portion and the proximal side wall portion; and a first rear sight cover selectively coupleable to the holster body so as to cover the rear accessory sight opening, the first rear sight sized to cover the iron sights;

a second rear sight cover selectively coupleable to the holster body so as to cover the rear accessory sight opening, the second rear sight cover dimensioned to receive the reflex sight mounted to the handgun.

2. The system of claim 1, further comprising a capture and release mechanism for retention of the handgun in the holster.

3. The system of claim 1 wherein the holster body includes a pair of inwardly facing grooves that receive a pair of rails on each of the first rear sight cover and the second rear sight cover.

4. The system of claim 1 wherein each of the first rear sight cover and the second rear sight cover comprises a latch member, the latch member comprising a resilient cantilever portion supporting a protrusion portion, the protrusion portion having a ramped surface, the holster body having an aperture for receiving the protrusion portion.

5. The system of claim 4, wherein the ramped surface is adapted and dimensioned so that deflection of the resilient cantilever portion of the latch member occurs as the ramped surface slides along a cooperating surface of the upper wall portion of the holster body as each of the first rear sight cover and the second rear sight cover is engaged with the holster body.

6. The system of claim 5, wherein bending stresses in the resilient cantilever portion are released, at least in part, when the protrusion portion is received in the aperture defined by the upper wall portion of the holster body.

7. The system of claim 5, wherein the cantilever portion and aperture define a snap-on connection.

8. A holster system for receiving and releasably retaining a handgun with or without a reflex sight mounted thereto, the holster system comprising:

a holster body comprising opposing side wall portions joined by a unitary upper wall portion;

the opposing side wall portions and unitary upper wall portion of the holster body defining a cavity with an open rearward end, the cavity defining a handgun receiving and withdrawal axis extending forwardly and rearwardly;

the holster body defining a rear accessory sight opening for receiving the reflex sight when the handgun is at least partially received in the cavity and the reflex sight attached thereto, the rear accessory sight opening positioned at a rearward end of the upper wall portion and positioned intermediate the distal side wall portion and the proximal side wall portion;

a rear sight cover selectively coupleable to the holster body so as to cover the rear accessory sight opening, the rear sight cover dimensioned to receive the reflex sight mounted to the handgun, the rear sight cover slidable into and latchable to the holster body.

9. The system of claim 8, further comprising a capture and release mechanism for retention of the handgun in the holster.

10. The system of claim 8, where in the rear sight cover is a first sight cover, and the holster system further comprises a second sight cover selectively coupleable to the holster body so as to cover the rear accessory sight opening, the first sight cover comprising a hump portion, the hump portion defining a sight accessory pocket, the sight accessory pocket being dimensioned and configured to receive the reflex sight mounted to the handgun.

11. The holster system of claim 10, wherein each of the first sight cover and second sight cover attach to the holster body by way of cooperating rails and slot connection.

12. The system of claim 11, wherein each of the first sight cover and second sight cover comprises a latch, wherein the latch comprises a latch member, the latch member comprising a resilient cantilever portion supporting a protrusion portion, the protrusion portion having a ramped surface, the protrusion portion for engaging with a latch aperture.

13. The system of claim 9, wherein the rear sight cover attaches by way of a plurality of overlapping edge portions, the sight cover having a plurality of overlapping edge portions that cooperate with a plurality of overlapping edge portions of the holster body.

14. The system of claim 13 wherein the rear sight cover has a plurality of stop surfaces that engage the plurality of overlapping edge portions of the holster body.

15. The system of claim 10 wherein each of the first sight cover and the second sight cover is attachable by a snap-on connection with the holster body, wherein the snap-on connection comprises a cantilevered portion having a protrusion portion, the protrusion portion having a ramped surface.

16. The system of claim 15 wherein the upper wall portion of the holster body defines an aperture and the protrusion portion is received in the aperture when each of the first sight cover and the second sight cover is selectively coupled to the holster body.

17. The system of claim 9 wherein the capture and release mechanism comprises a sleeve that extends over a handgun slide and is engageable to deflect an ejection port engagement member, the sleeve positioned forward of the accessory sight opening.

18. A holster system for receiving and releasably retaining a handgun with one of a first and a second differently configured sight mounted thereto, the holster system comprising:

a holster body comprising opposing side wall portions and an upper wall portion extending between the side wall portions, holster body defining a cavity with an open rearward end, the cavity defining a handgun receiving and withdrawal axis extending forwardly and rearwardly;

the holster body defining a rear accessory sight opening for receiving the handgun with the reflex sight attached thereto, the rear accessory sight opening positioned at a rearward end of the upper wall portion and positioned intermediate the distal side wall portion and the proximal side wall portion;

a first rear sight cover selectively coupleable to the holster body so as to cover the rear accessory sight opening, the first rear sight cover sized to cover the first sight mounted to the handgun;

a second rear sight cover selectively coupleable to the holster body so as to cover the rear accessory sight opening, the second rear sight cover dimensioned to cover the differently configured second sight mounted to the handgun.

19. The holster system of claim 18, further comprising a capture and release mechanism for securing the handgun in the holster and releasing the handgun by depression of a pushbutton.

20. The holster system of claim 18, wherein the second sight is a reflex sight, and wherein the second rear sight cover comprises a hump portion, the hump portion defining a sight accessory pocket, the sight accessory pocket being dimensioned and configured to receive the reflex sight mounted to the handgun.

* * * * *